United States Patent [19]

Dale et al.

[11] 4,317,460

[45] Mar. 2, 1982

[54] SMOKING PRODUCTS

[75] Inventors: Robert W. Dale; John J. Rooney, both of Belfast, Northern Ireland

[73] Assignee: Gallaher Limited, London, England

[21] Appl. No.: 4,215

[22] Filed: Jan. 17, 1979

[30] Foreign Application Priority Data

Jan. 20, 1978 [GB] United Kingdom ..... 2392/78

[51] Int. Cl.[3] ..... A24B 15/04; A24D 1/06

[52] U.S. Cl. ..... 131/334; 423/247

[58] Field of Search ..... 131/2, 17 R, 140 B, 131/15 R; 423/247

[56] References Cited

U.S. PATENT DOCUMENTS

| | | | |
|---|---|---|---|
| T901,024 | 8/1972 | Sloan | 131/266 |
| 3,355,317 | 11/1967 | Keith et al. | 131/10.9 |
| 3,368,566 | 2/1968 | Avedikian | 131/10.7 |
| 3,472,237 | 10/1967 | Stephens | 131/17 R |
| 3,790,662 | 2/1974 | Cloyd | 423/437 |
| 4,055,191 | 10/1977 | Norman et al. | 131/9 |

FOREIGN PATENT DOCUMENTS

| | | | |
|---|---|---|---|
| 1438557 | 6/1976 | United Kingdom | 131/261 R |

OTHER PUBLICATIONS

"Catalytic Cigarette Filter for Carbon Monoxide Reduction" by Rave & Lloyd, J. Air Polution Control Assoc., vol. 28, Part 3, pp. 253-255, 3/1978.

"Development of Ethylene Process Vinyl Acetate and Process Comparisons" by Ohmcie:Chemical Economy & Engineering Review, 11/1972, vol. 4, No. 11 (No. 55).

*Primary Examiner*—V. Millin

*Attorney, Agent, or Firm*—Murray and Whisenhunt

[57] ABSTRACT

Catalysts for the low temperature oxidation of carbon monoxide to carbon dioxide, used in smoking product filters, are described. The catalysts are carried upon a support which should be microporous. The catalysts may include mixtures of tin or tin compounds with other catalytic material. The catalysts may involve a Redox mechanism. The catalysts exhibit resistance to deactivation caused by contact with water.

37 Claims, No Drawings

SMOKING PRODUCTS

Upon smoking a smoking product, such as a cigarette, carbon monoxide is formed at and near the burning tip and a gaseous mixture containing carbon monoxide is drawn through the mouth end of the cigarette. The proportion of carbon monoxide depends, inter alia, on the air supply through the walls of and along the length of the smoking product. By increasing the air supply the proportion of carbon monoxide can be reduced but even with optimum air supply the gas will still contain a significant proportion of carbon monoxide.

It is known to include absorbents, generally in a filter tip, to absorb physically some of the carbon monoxide but these do not remove sufficient. It is also known to include, generally in a filter tip, catalysts or oxidants to oxidise carbon monoxide to carbon dioxide. There is a discussion of various oxidants and catalysts for this purpose in publication FTR5 by J. W. Reynolds from Eastman Chemical Products Inc., entitled "Results of Experimental Work to Remove CO from a Mixture of $O_2$ and $N_2$ by Use of Modified Cigarette Filters".

Many of the materials discussed in that report are based on hopcalite, which contains copper oxide and manganese dioxide and is thus an oxidant rather than a catalyst but catalysts such as palladium on molecular sieve were also tested. The report concluded that all the tested materials were unsatisfactory. Thus even at 80° C. hopcalite only removed 60% of the carbon monoxide in the tests described and was deactivated by water while other catalysts were less sensitive to water but were even less effective at removing carbon monoxide. For instance 0.5% palladium on molecular sieve was stated to remove only 2% carbon monoxide in the test described.

A smoking product or filter for a smoking product according to a first aspect of the invention comprises a catalyst for low temperature oxidation of carbon monoxide to carbon dioxide and which comprises a support carrying at least one catalytically active metal, present as the metal or a metal compound, and which has an activity at 25° C. of 60 to 100% after 10 puffs of a test gas mixture, as herein defined.

The defined activity is determined by forming a gas mixture of 3% CO, 10% $CO_2$, 13% $O_2$ and 74% $N_2$ and puffing this over 500 mg of the catalyst being tested and analysing the resultant gas mixture and hence determining the conversion of carbon monoxide, each puff constituting 35 ml of the gas mixture at atmospheric pressure and being passed for two seconds over the catalyst at the rate of one puff per minute. Preferably the catalyst has an activity of from 60 to 100% after 20 puffs and most preferably after 30 puffs, and in particular it preferably has an activity substantially of 100% after 10 puffs. Since activity tends to decrease with usage, all catalysts according to the invention inevitably will have an activity of greater than 60%, and generally 100%, after 3 puffs whereas the greatest activity described in the article by Reynolds was 50% after 3 puffs, and most activities were much less, for example 2% for palladium on molecular sieve.

According to a second aspect of the invention a smoking product or filter comprising a catalyst which has an activity at 25° C. of from 50 to 100% after 3 puffs and 30 to 100% after 10 puffs of a tobacco smoke vapour phase as herein defined. This activity is determined in the same manner as the activity of the gas mixture but the smoke mixture used is tobacco smoke and contains moisture. Preferably the catalyst used in smoking products or filters according to the invention has both this activity on the smoke mixture and also the defined activity on the test gas mixture.

The metal is generally selected from iron, cobalt, nickel, ruthenium, rhodium, palladium, osmium, platinum, chromium, rhenium, tungsten and tin. In many embodiments of the invention it is present as the metal but some metals, e.g. tin, may be present as oxide or other compound while in others, especially those involving a redox mechanism and described below, the metals will be in ionic or salt form.

We have found a number of independent steps which when used in the preparation of catalysts comprising a support and catalytically active metal or metal compound give a very useful improvement in activity over that obtainable by traditional methods and which when used together give particularly satisfactory results. Thus the described steps may be used individually or in any compatible combination thereof.

In one step a catalyst is made by generating in a hydroxyl containing solid support material surfaces activated by having a deficiency of hydroxyl groups and contacting the activated surfaces while still activated with a solution of a substance providing catalytically active material. These hydroxyl deficient surfaces can be made by heating the support material but preferably are made by crushing pellets of the support material. A preferred process comprises heating the support material to a temperature of at least 20° C. above the temperature at which expulsion of chemisorbed water is substantially completed but below the temperature at which substantial degradation of the support material occurs and impregnating the support while still activated. In one method the material that is heated is in the form of a powder having a particle size of less than 50 microns whilst in another method the heating is conducted substantially immediately prior to or during the manufacture of pellets of support material, and the activated surfaces are subsequently generated by crushing the pellets. The contact of the activated surfaces with the catalytically active material or the substance providing it should be made while the surfaces are still activated, that is to say before substantial deactivation occurs, as would happen if they were left exposed to the atmosphere for several days. Generally contact is within 3 hours of generating the active surfaces.

When the active surfaces are generated by crushing, it seems that the active form was generated during initial manufacture of the pellets and was trapped within and protected from ageing influences by the outer layers of the pellets, and the surfaces are exposed by the crushing.

Heating steps used for activation generally involve heating at between 300° and 800° C., most preferably between 400° and 650° C., especially 500° to 600° C., particularly when the support is a zeolite or alumina. The removal of chemisorbed water and subsequent creation of a deficiency of hydroxyl groups can be observed by differential thermal analysis. The heating is best conducted by calcining in air or nitrogen for a period that can be determined by routine experimentation, usually from 6 to 24 hours. More details of this method are described in our copending application Ser. No. 4,277 entitled "Catalysts" filed even date herewith by the present applicants (and which claims priority from British Application No. 2391/78), and the entire disclosure of which is incorporated herein by reference.

Another way of improving activity arises from the method of impregnating the support with the catalytically active material. Traditional methods have used a wholly aqueous solution of the substance providing the catalytically active material or, in rare instances, a wholly organic solution. In the invention improved activity is obtained when a microporous support material is impregnated with a solution of a substance providing the catalytically active material in a mixture of water and an organic liquid that reduces the surface tension of the solution. In a simple method the solvent may be a 50/50 mixture of water and methanol. Broadly, best results are obtained when the organic liquid constitutes 10 to 90% preferably 50 to 80%, by volume of the mixture, is inert to the catalytically active material, reduces the hydrogen bonding within the solution and between the solution and the support, and is wholly miscible with the water in the solution. Often it is preferred that it has molecular dimensions smaller than the pore size of the support material. Preferred organic liquids are selected from alcohols and cyclic ethers, in particular being selected from tetrahydrofuran, methanol, ethanol, dioxan and furan, methanol generally being preferred. They are generally aliphatic or alicyclic. More details of this method are described in our copending application Ser. No. 4,216 entitled "Catalysts" filed even date herewith by the present applicants (and which claims priority from inter alia the complete specification of British application No. 23257/78) and the entire disclosure of which is incorporated herein by reference.

Another way of improving activity of the catalyst comprises impregnating the support material with the substance providing the catalytically active material in anionic form, instead of the more usual cationic form. This is of particular value when the support material has been activated by dehydroxylation and when impregnation involves physical adsorption of the substance into the material, instead of the more usual ion exchange. Thus contact between the solution and the support is preferably maintained while at least some, for example 50 to 100%, of the solvent evaporates, this being particularly preferred when the catalytic material is in anionic form.

Another way of improving activity comprises selection of the manner of reducing the catalytically active material that is deposited on the support. Various methods of reduction are known and can be used but best activity seems to be obtained for low temperature catalysts, as are required in the invention, when the reduction is by carbon monoxide.

A preferred method of making a catalyst for use in the invention comprises starting with a zeolite, for example 3A, 4A, 5A, 10X or 13X (4A, 5A or 13X being preferred) dehydroxylating this to activate it, physically absorbing a solution (in water and an organic liquid that reduces the surface tension of the solution) of the catalytically active material in anionic form, at least partially evaporating the solvent, and reducing the catalyst by carbon monoxide.

Preferably the catalyst comprises a microporous support having a pore diameter below 30 Å and carrying a catalytically active material deposited predominantly within the pores. The diameter is preferably less than 16 Å. The diameter is preferably at least 4 Å. Preferably the amount of catalytically active metal or metal compound deposited within these micropores is at least 0.1% of the total weight and often it is deposited atomically dispersed within the pores. It seems that previous catalysts proposed for smoking products, such as the catalysts discussed in the article by Reynolds, had little or no catalytic material deposited within any micropores in the catalytic support. Instead most at least of the catalyst metal was probably deposited on the outer exposed surfaces of the support in relatively thick and non-uniform layers.

By depositing the catalytic metal in the described mono-layer fashion within the described microporous structure not only is good activity obtained but also poisoning by large molecules such as tar molecules is prevented, the microporous structure acting as a physical filter to prevent such poisoning.

The metals that may be used as the catalyst, or as the metallic component of a catalytically active compound, can be selected from all the metals known to be useful as oxidation catalysts and include transition metals, most preferably of Groups 6, 7 and 8 noble metals being particularly preferred. Preferred metals are iron, cobalt, nickel, ruthenium, rhodium, palladiu, osmium, platinum, chromium, rhenium and tungsten, and also tin. Particularly preferred are catalysts containing platinum, palladium, rhodium, rhenium and tin. However, particularly desirable results are obtained when mixtures of metals are used, especially mixtures of platinum or palladium with rhodium, rhenium or tin. Especially preferred are catalysts based on platinum or palladium or palladium and rhodium, together with tin. While palladium or platinum are generally present in metallic form the tin may be present as stannous oxide. Such catalysts have more stable activity in the presence of moisture.

According to a third aspect of the invention a smoking product or a filter for a smoking product comprises a catalyst for low temperature oxidation of carbon monoxide to carbon dioxide which comprises a support carrying tin which may be present as the metal or a metal compound, and at least one other metal selected from nobel metals, transition metals and metals of Groups 6, 7 and 8 and which may be present as metal or metal compound. Preferably this other metal is selected from platinum, iron, cobalt, nickel, ruthenium, rhodium, osmium, chromium, rhenium and tungsten. Most preferably the support carries palladium or a compound thereof and tin or a compound thereof, and optionally other catalytic materials. Such catalysts may be carried on supports such as those described above and in the cross-referenced applications.

All the described catalysts have surprisingly good activity in the presence of moisture but particularly satisfactory results are obtainable if the catalyst is one that functions by a redox mechanism that involves reaction with water. Thus a smoking product or filter for a smoking product according to a fourth embodiment of the invention comprises a support carrying catalytically active materials that will effect the low temperature oxidation of carbon monoxide to carbon dioxide by a redox mechanism that involves reaction with water.

Such a catalyst involves first and second redox components. The first (e.g. a palladium or other noble metal compound) catalytically oxides the carbon monoxide and is reversibly reduced in the reaction. The second (e.g. a copper salt) then serves as an oxidising agent to reoxidise the first component back to a catalytically active state and is reversibly reduced in the reaction. The second is then reoxidised to a state in which it is able to oxidise the first component again. In the catalysts used in this fourth embodiment of the invention at least one of these three reactions involves reaction with moisture with the result that the overall redox system does not function at all, or functions with very low activity, in a wholly anhydrous environment.

Redox catalysts used in solution, i.e. in the liquid phase without a support, and which operate by this general mechanism are well known and are often referred to as Wacker catalysts and redox catalysts that are carried on a support and function by this mechanism are also known and are used commercially for, for instance, the production of vinyl acetate. Such catalysts are described in, for instance, British Patent Specification No. 976,613, U.S. Pat. No. 3,300,528 and pages 46 to 57 of Chemical Economy and Engineering Review November 1972 Volume 4 No. 11 to all of which reference should be made for full disclosure of the first and second components and the entire disclosure of which is incorporated herein by reference.

Although the first component is usually of a noble metal such as palladium any metal that is capable of catalytically oxidising carbon monoxide to carbon dioxide while entering into the necessary redox reaction can be used. Similarly although the second component is generally provided by a metal (as a salt) again any compound that can undergo the necessary redox reaction can be used. It is usually a metal compound, for example a salt of copper, tin or iron, but it can be an organic compound, for instance a quinone such as benzoquinone.

The second component normally is one that has a low redox potential in the system, for instance below 1 and usually below 0.5, e.g. 0.05 to 0.3 volts. Particularly good results have been obtained using copper salts or tin salts or mixtures thereof as the second component, especially when the first component is a palladium compound.

The first and second components may be present in any form that permits them to enter into the necessary redox reactions. The second component is preferably such as to provide a metal in cationic form and thus a salt with any suitable anion, for example halide (generally chloride), sulphate or nitrate may be used. The first component may be introduced in the cationic form, e.g. $Pd^{2+}$ (usually as $PdCl_2$) but preferably is anionic, for instance $PdCl_4^{-2}$.

The amount of the first component is always less than the amount of the second component and generally is less than 50% of the weight of the second component. For instance it may be 5 to 20% by weight of the second component. Typically the amount of first component is 0.1 to 0.5% while the amount of second component is 1 to 10%, usually 2 to 7% by weight of the total catalyst. The second component may be provided by more than one material in which event the materials used preferably have similar redox potentials. One of the materials of the second component may be present in a minor amount, e.g. similar to the amount of the first component, while the other is generally present in a larger amount.

The first and second components are carried on a support which may be macroporous or microporous but best results are obtained when it is microporous, having a pore size of 30 Å or less, generally 4 to 16 Å. While charcoal, for instance coconut charcoal which has been partially oxidised by air heating at about 500° C. in order to activate it, and alumina may be used more highly microporous supports such as zeolites, e.g. zeolite 13X, are preferred.

The first and second components may be deposited on the support in known manner but best results are obtained if the catalyst is made by substantially saturating the surfaces of the support with some or all of the second component (or a compound capable of providing the second component upon heating) and then depositing the minor amount of the first component (or a compound capable of providing the first component upon heating). Thus a redox catalyst made by this method constitutes a further aspect of the invention. Such a redox catalyst is of particular value for the low temperature oxidation of carbon monoxide to carbon dioxide in smoking products or filters for smoking products but can also be used in any environment where a redox catalyst is required, for instance in the production of vinyl acetate or in a catalytic converter for an automobile exhaust.

Although successive deposition of the components of the catalyst is mentioned in column 2 of U.S. Pat. No. 3,300,528 it has not previously been appreciated that very beneficial results, particularly for catalysts intended for low temperature oxidation of carbon monoxide, can be obtained if the support surfaces are initially substantially saturated with the promotor and then only a minor amount of the noble metal is deposited.

The second component, or at least the major proportion of it, is preferably a metal salt and saturation of the support surfaces with it may be achieved by impregnating the support with a solution of the salt, permitting ion exchange to occur, removing excess liquid and then repeating the process at least one and usually more, e.g. 3 to 6 times, and finally washing the catalyst and drying it.

The solution should not be too concentrated as otherwise the activity may be impaired, and generally has a concentration of below 50 g/l, preferably 20 to 40 g/l. The solvent is generally water.

The first component may be introduced as a solution in any suitable solvent, preferably a substantially non-aqueous solvent. Methanol and dichloromethane are particularly suitable as the solvent or as components of the solvent. Minor amounts of other second components, for example stannic chloride, may be introduced in this solution. The support is then dried.

Best activity occurs if the support is then heated at moderate temperatures for half to 4 hours, generally under ambient atmospheric conditions. Temperatures of 100° to 200° C. for about 2 hours are generally satisfactory.

One preferred redox system includes compounds of palladium and copper and optionally tin. Another includes compounds of manganese (generally as the second component) and cerium.

The described catalysts are normally in powder form, e.g. below 50 microns, and may be distributed through smoking products or included in a filter for a smoking product. Preferably they are included in a filter. The filter may be a triple filter, with catalytic powder, either by itself or mixed with absorbents such as granular carbon, in a central component between fibrous end portions. The powder may be loose or may be bonded into a porous plug. The powder may also be bonded to fibres that form the central portion of a triple filter or that are distributed throughout some or all of any filter construction or may be bonded to a sheet which is crumpled or spirally wound to form part or all of a filter.

The following are examples of catalysts suitable for use in smoking products of the invention.

Example 1

13X zeolite pellets containing clay binder and having a particle size of 1.5 to 3 mm were ground in a domestic grinder and were then sieved to leave a fraction having a particle size of 30 to 60 mesh. Within 1 hour three grams of this powder was mixed with 20 ml water containing 0.75 ml chloroplatinic acid solution (5% w/v) (i.e. an aqueous solution containing 750 ppm platinum). The mixture was left for 12 hours at about 40° C. by which time the solution had evaporated to dryness to leave a free-flowing powder.

EXAMPLE 2

The method of Example 1 is repeated except that contact between the solution and the powder is maintained for, for instance, 10 hours, preferably under reflux, and excess solution is then decanted and the wet powder evaporated to dryness.

EXAMPLE 3

The method of Example 1 is repeated except that the solution is a 50% water-50% methanol solution and reduction is by formaldehyde.

EXAMPLE 4

The method of Example 2 is repeated except that the powdered zeolite is first contacted with stannous or stannic ions and after drying is then contacted with chloroplatinic acid of the same or similar concentration.

After drying, the products of each of Examples 1 to 4 are reduced by carbon monoxide at 350° C.

All these catalysts have exceptionally good activity for use in smoking products and preferably are incorporated in filters in the manner described above. In particular they all had an activity of 100% after 10 puffs of a gas mixture as described above and an activity of above 30% after 10 puffs of a smoke mixture containing tars.

To demonstrate the increase in activity obtainable independently by each of the various steps described above a number of further experiments were conducted. In each of these activity was determined on a gas mixture of CO, $CO_2$, $O_2$ and $M_2$ by the method described above.

EXPERIMENT 1

Aged zeolite 13X molecular sieve was preheated to various temperatures for various times and was then contacted with sufficient of an aqueous solution of chloroplatinic acid to deposit 2% platinum. When the preheating was at temperatures of below 400° C. the activity was found to be less than about 20%. However when preheating was conducted at temperatures above 400° C. over night a rapid increase in activity was observed, with a value of about 70% at temperatures of 500° to 600° C. and a value of about 100% at a temperature of 580° C. when a similar support was preheated at 580° C. for 5 days immediately prior to deposition of the platinum, it was found to have an activity of 100% after 20 puffs and 80% after 30 puffs.

EXPERIMENT 2

In a separate experiment, zeolite 13X had 2% platinum deposited in it as chloroplatinic acid and the catalyst was then reduced by heating at 350° C. When reduction was conducted for 3 hours using hydrogen the activity was 53%, whilst when it was conducted for 2 hours with hydrogen followed by one hour with carbon monoxide the activity was about 80% whilst when all the reduction was with carbon monoxide, for 3 hours, the activity was 100%, and was still 100% after 20 puffs and was 90% after 30 puffs.

EXPERIMENT 3

In a separate series of experiments on the effect of altering reduction conditions a support zeolite 13X containing 1% platinum was reduced with carbon monoxide for 3 hours at temperatures of between 150° and 450° C. Best results were obtained at temperatures of from 250° to 400° C., with the optimum activity being obtained at a temperature of 350° C.

EXPERIMENT 4

13X zeolite pellets were crushed and sieved as in Example 1, and then impregnated with various solutions of chloroplatinic acid sufficient to give 0.5% platinum. When the volume of solution was 5 ml and the solvent was solely water the activity was 75 whilst in a parallel experiment when the volume was 10 ml and the solvent was a mixture of equal parts water and methanol the activity was 100% after 10 puffs and 73% after 20 puffs.

EXAMPLE 5

Zeolite 4A powder is heated at a temperature of about 580° C. to activate it, and impregnated with chloroplatinic acid solution in equal parts of water and methanol. It was left for 12 hours at about 40° C. by which time the solution had evaporated to dryness to leave a free flowing powder. The platinum was then reduced by carbon monoxide at 350° C. Like the products of Examples 1 to 4, the resultant catalyst had good activity and was preferably incorporated in a filter in the manner described above.

EXAMPLE 6

Zeolite 13X was immersed in an aqueous solution of 30 g/l cupric chloride, left to soak in that solution to permit ion exchange to occur and was then separated from the remaining solution. The separated product was then immersed in fresh solution and the whole process repeated until it had been given five immersions. Analysis showed at that time that the catalyst contained from 5 to 6% copper based on the dry weight. The product was then washed with water and dried. It was then immersed in a solution of equal parts methanol and methylene dichloride containing about 0.5% $Na_2PdCl_4$ and 0.5% stannic chloride, both measured as metal. The product is dried at room temperature and is then heated at 150° C. for 2 hours while exposed to the ambient atmosphere.

The resultant catalyst has an activity of about 85% in the smoke mixture test described above and an activity at least as high as this on the synthetic test mixture test described above.

We claim

1. A smoking product filter containing a catalyst for the low temperature oxidation of carbon monoxide to carbon dioxide, said catalyst comprising a support selected from the group comprising microporous supports having a pore diameter of less than 30 Å, zeolite and alumina, said support carrying at least one catalytically active metal, present as the metal or a metal compound, said catalyst having an activity at 20° C. of 60 to 100% after ten puffs of a test gas mixture of 3% CO, 10% $CO_2$, 13% $O_2$ and 74% $N_2$.

2. Smoking product filter of claim 1, wherein said support is a zeolite or alumina microporous support having a pore diameter of less than 30 Å.

3. A smoking product filter according to claim 1 comprising at least one catalytically active metal, which may be present as the metal or a metal compound, which is selected from the group consisting of iron, cobalt, nickel, ruthenium, rhodium, palladium, osmium, platinum, chromium, rhenium, tungsten and tin.

4. A smoking product filter according to claim 1 wherein said catalytically active metal, present as the metal or compound thereof, is both tin and a metal selected from the group consisting of platinum and palladium.

5. A smoking product filter according to claim 1, wherein said support is said microporous support.

6. A smoking product filter of claim 1, wherein said support is a zeolite or alumina.

7. A smoking product filter according to claim 1, wherein the catalyst is made by depositing a compound of catalytically active metal within said support and thereafter reducing the compound by carbon monoxide.

8. A smoking product filter of claim 1, wherein the catalyst is made by depositing a compound of said catalytically active metal within the support by impregnating the support with a solution of said compound in a mixture of water and an organic liquid that reduces the surface tension of the solution.

9. A smoking product filter of claim 8, wherein said solution contains from 50 to 80% methanol and 50 to 20% water.

10. A smoking product filter of claim 1, wherein the support is a hydroxyl-containing support and the catalyst is made by providing activated support surfaces having a deficiency of hydroxyl groups and contacting the activated support surfaces while thus activated with a solution of a compound of catalytically active metal.

11. A smoking product filter according to claim 10, wherein the support is activated by crushing support pellets and contacting the crushed support with the solution while so activated.

12. A smoking product filter containing a catalyst for the low temperature oxidation of carbon monoxide to carbon dioxide, said catalyst comprising a support selected from the group comprising microporous supports having a pore diameter of less than 30 Å, zeolite and alumina, said support carrying at least one catalytically active metal, present as the metal or a metal compound, said catalyst having an activity at 25° C. of from 60 to 100% after three puffs, and 30 to 100% after ten puffs, of a tobacco smoke vapor phase-containing tobacco smoke and moisture.

13. Smoking product filter of claim 12, wherein said support is a zeolite or alumina microporous support having a pore diameter of less than 30 Å.

14. A smoking product filter containing a catalyst for the low temperature oxidation of carbon monoxide to carbon dioxide, said catalyst comprising a support selected from the group comprising microporous supports having a pore diameter of less than 30 Å, zeolite and alumina, said support carrying tin and at least one other metal selected from the group consisting of noble metal, transition metal and metals of Groups 6, 7 and 9, said tin and said other metal being present as metal or metal compounds.

15. Smoking product filter of claim 14, wherein said support is a zeolite or alumina microporous support having a pore diameter of less than 30 Å.

16. A smoking product filter of claim 14 wherein said other metal is selected from the group consisting of platinum, iron, cobalt, nickel, ruthenium, rhodium, osmium, chromium, rhenium and tungsten.

17. A smoking product filter according to claim 14, wherein said support carries tin or a compound of tin and palladium or a palladium compound.

18. A smoking product filter containing a catalyst for low temperature oxidation of carbon monoxide to carbon dioxide, said catalyst comprising a support selected from the group comprising microporous supports having a pore diameter of less than 30 Å, zeolite and alumina, said support carrying catalytically active metal, present as the metal or a metal compound, said catalytically active metals catalytically oxidizing at low temperature carbon monoxide to carbon dioxide by a redox mechanism involving water.

19. Smoking product filter of claim 18, wherein said support is a zeolite or alumina microporous support having a pore diameter of less than 30 Å.

20. A smoking product filter according to claim 18, wherein the catalytically active metals comprise palladium or a compound thereof and tin or a compound thereof.

21. A smoking product filter according to claim 18, wherein the support is said microporous support.

22. A smoking product filter of one of claims 18 or 21, wherein said catalytically active metal additionally comprises copper or a compound thereof.

23. A redox catalyst system comprising a support selected from the group comprising microporous supports having a pore diameter of less than 30 Å, zeolite and alumina, a first redox component for catalytically oxidizing material contacted by the catalyst, and a second redox component for oxidizing the first component during use of the catalyst, said catalyst being the catalyst obtained by substantially saturating the surface of the support with at least some of the second component or precursor thereof, and then depositing on said support a minor amount of said first component or precursor thereof, said catalyst system exhibiting resistance to deactivation caused by the presence of moisture, wherein said catalyst contains up to 0.5% by weight of said first component, based on total catalyst weight, and from 1 to 10% by weight of said second component, based on total catalyst weight.

24. Redox catalyst system of claim 23, wherein said support is a zeolite or alumina microporous support having a pore diameter of less than 30 Å.

25. Catalyst system of claim 23, wherein the second component is a metal compound and the surfaces of the support are saturated with at least some of the second component by impregnating the support with a solution of a salt of the metal and permitting ion exchange to occur, removing excess liquid, and repeating the impregnation step at least once.

26. Catalyst system of claim 25, wherein the solution has a concentration of 20 to 40 g/l.

27. Catalyst system according to claim 26, wherein the first component is a metal compound which is introduced into the support as a solution of a compound of the metal in a substantially non-aqueous solvent.

28. A catalyst system of claim 27, wherein said solvent comprises methanol and/or dichloromethane.

29. Catalyst system according to claim 23, wherein said support is said microporous support.

30. Catalyst system of claim 23, wherein the second component comprises a major amount of a compound of a metal and a minor amount of a compound of another metal, and in which the metal providing the said minor amount is deposited onto the support with the first component.

31. Catalyst system according to claim 23, wherein the first component comprises a noble metal compound and the second component comprises a compound of a metal selected from the group consisting of copper and tin.

32. Catalyst system of claim 23, wherein said catalyst system comprises a palladium compound and a copper compound.

33. A catalyst system according to claim 32, wherein said catalyst system additionally comprises tin or a compound thereof.

34. A smoking product or a filter for a smoking product comprising a catalyst according to any of claims 23, or 25 to 33.

35. A smoking product filter containing a catalyst for low temperature oxidation of carbon monoxide to carbon dioxide, said catalyst comprising a support selected from the group comprising microporous supports having a pore diameter of less than 30 Å, zeolite and alumina, said support having on at least the surface thereof a catalytically active redox couple, said couple catalytically oxidizing at low temperature the oxidation of carbon monoxide to carbon dioxide by a redox mechanism involving water, said catalyst exhibiting resistance to deactivation caused by contact with water.

36. Smoking product filter of claim 35, wherein said support is a zeolite or alumina microporous support having a pore diameter of less than 30 Å.

37. A catalyst according to claim 35, wherein the catalyst has been activated by heating for one-half to four hours at 100° to 200° C.

* * * * *